US005435152A

United States Patent [19]

McCausland

[11] Patent Number: 5,435,152

[45] Date of Patent: Jul. 25, 1995

[54] AIR TREATING DEVICE HAVING A BELLOWS COMPRESSOR ACTUABLE BY MEMORY-SHAPED METAL ALLOY ELEMENTS

[75] Inventor: Robert McCausland, Laval, Canada

[73] Assignee: Microcool Corporation, Wilmington, Del.

[21] Appl. No.: 198,286

[22] Filed: Feb. 18, 1994

[51] Int. Cl.[6] ..... A62B 7/14

[52] U.S. Cl. ..... 62/467; 62/DIG. 2; 62/259.3; 62/119; 417/413.1

[58] Field of Search ..... 62/118, 119, 259.3, 62/231, 467, DIG. 2; 417/413

[56] References Cited

U.S. PATENT DOCUMENTS 3,526,102 9/1970 Boylett et al. ..... 62/259.3
3,526,223 9/1970 Curtis ..... 128/142.5
3,606,592 9/1971 Medurski et al. ..... 417/413

*Primary Examiner*—Henry A. Bennet
*Assistant Examiner*—William C. Doerrler

[57] ABSTRACT

An air treating device having a bellows box in which is mounted a bellows compressor formed of two spaced apart diaphragms having memory-shaped metal alloy elements embedded therein. The diaphragms are caused to contract and expand by selective heating of the memory-shaped metal alloy elements. The bellows compressor is supported spaced in the bellows box whereby air can flow through the box and as the bellows expand the air in the box is cooled and expelled. As the diaphragms of the bellows compressor contract, more air is sucked into the bellows box and at the same time the refrigerant fluid inside the bellows is expelled into a condenser where it is condensed to liquid. When the refrigerant liquid enters into the bellows it is vaporized and cools the bellows walls in their expanded state and the diaphragms act as a heat exchanger to cool air in said bellows box and expel it therefrom.

18 Claims, 3 Drawing Sheets

AIR TREATING DEVICE HAVING A BELLOWS COMPRESSOR ACTUABLE BY MEMORY-SHAPED METAL ALLOY ELEMENTS

TECHNICAL FIELD

The present invention relates to an air treating device having a bellows compressor formed of two spaced apart diaphragms located in a bellows box and which are caused to expand and contract by memory-shaped metal alloy elements which are heated respectively at a predetermined rate.

BACKGROUND ART

The air treating device of the present invention is activated by memory-shaped metal alloy elements. These memory-shaped metal alloy elements cause a diaphragm to be displaced thereby moving air. Fluid pumps using diaphragms which are actuated by memory-shaped metal alloy elements are known, such as disclosed in U.S. Pat. No. 3,606,592. This patent discloses a single diaphragm being mounted within a housing and when actuable causes liquid displacement through ports on both sides of the housing as the diaphragm moves thereacross due to the heating and cooling of its memory-shaped metal alloy elements. It is also known to use electrically actuated contractible elements to act as a pump in a prosthetic device for a biological system, such as disclosed in U.S. Pat. No. 3,827,426. The present invention uses this type of concept for displacing a pair of spaced apart diaphragm to act as a bellows, and more specifically a compressor which in turn cools and displaces surrounding air about the bellows which is mounted in a bellows box.

There is a need to provide an air treating device which is capable of cooling large volumes of air using minimal power in a light-weight application and wherein the device may be packaged in a very compact form for use in various applications, such as a military application to provide effective cooling of air pilot suits. This need has led to the development of the air treating device of the present invention.

Prior art compressors have included those having piezoelectric diaphragms, in which a piezoelectric ceramic material, such as barium titanate, is alternately pulsed to provide a direct mechanical output. While satisfactory for some applications, these devices suffer from the drawback of relatively low displacements of the piezoelectric material, leading to high power consumption, poor efficiencies, and complexity of design in the power circuit and valving, hence rendering such devices unsatisfactory for compressor or pump applications.

SUMMARY OF INVENTION

It is therefore a feature of the present invention to provide an air treating device which is compact, lightweight, simple in operation, reliable, capable of displacing high volume of air therethrough while cooling same, and wherein all of these capabilities are achieved using a very low energy source.

Another feature of the present invention is to provide an air treating device which utilizes a bellows compressor formed of two spaced apart memory shaped diaphragms mounted in a bellows box and which are activated to expand and contract by memory-shaped metal alloy elements and wherein each diaphragm has two separate layers of memory-shaped metal alloy elements which are electrically isolated from one another, each layer causing the expansion and contraction of each diaphragm.

According to the above features, from a broad aspect, the present invention provides an air treating device comprising a bellows box in which is secured a bellows compressor formed of two spaced apart diaphragms having memory-shaped metal alloy elements. Means is provided to cause said memory-shaped metal alloy elements to heat. Switch means is provided to cause the diaphragms to expand and contract at a predetermined rate. The diaphragms are secured in spaced sealing relationship and define an internal chamber therebetween. A gas entry and exit port is provided in the internal chamber. Unidirectional valve means is associated with the ports to permit entry and exit of a refrigerant fluid. A condenser is connected to the ports for the flow of the refrigerant fluid therethrough in a closed circuit. Air displacement is associated with the condenser. The bellows box further has a unidirectional airflow path therethrough. The diaphragms, when expanding, draw the refrigerant fluid through the entry port by suction and reduced pressure and thereby cause the refrigerant fluid to vaporize and cool the diaphragms as they expand. The expanded diaphragms cool the air in the unidirectional airflow path by heat exchange and simultaneously displaces cooled air in the unidirectional airflow path. The diaphragms, when contracting, cause the vaporized fluid to be expelled through the exit port into the condenser.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
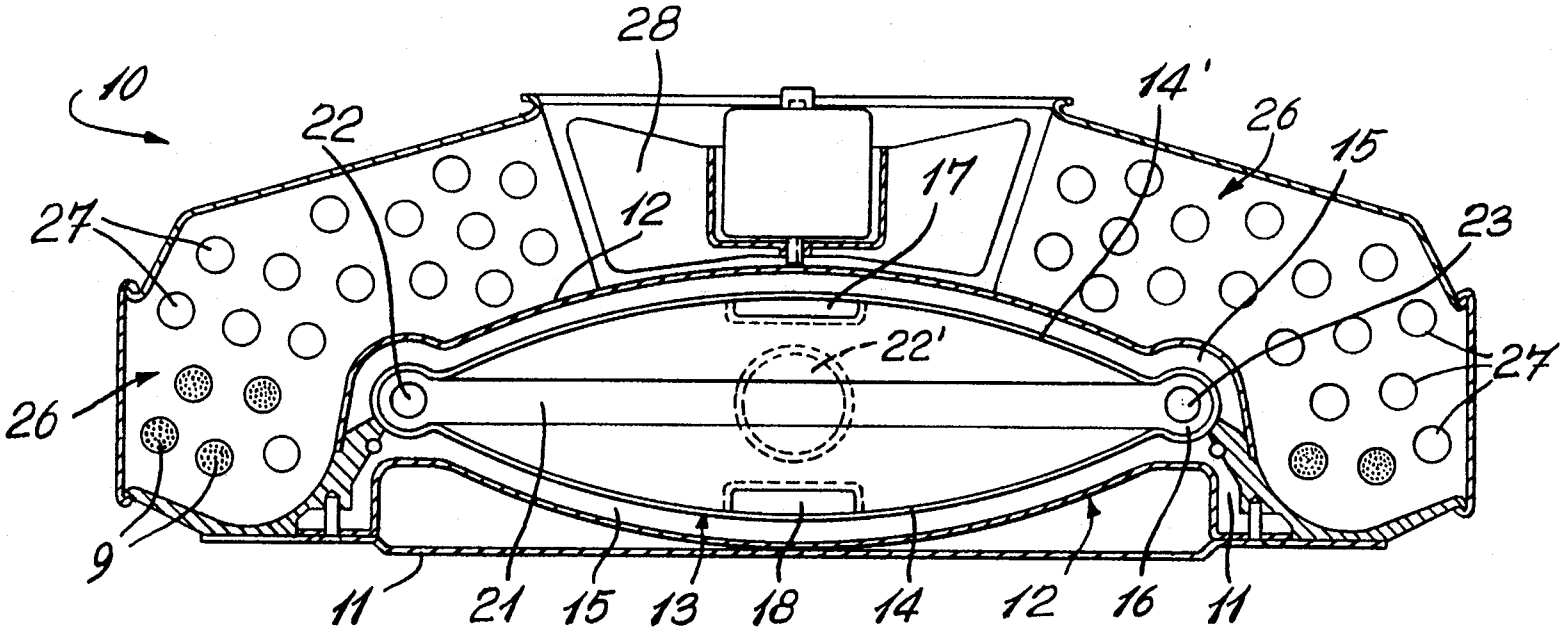
FIG. 1 is a cross-section view illustrating an air treating device constructed in accordance with the preferred embodiment of the present invention.
Figure 3:
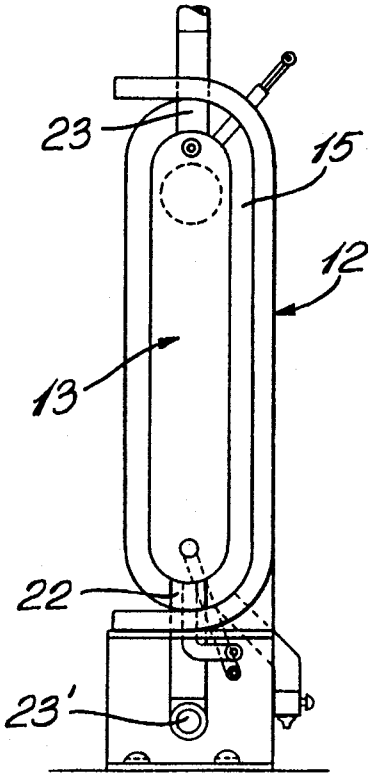
FIG. 3 is an end view of FIG. 2.

Referring now to the drawings and more specifically to FIG. 1, there is shown generally at 10 an example of an air treating device constructed in accordance with a preferred embodiment of the present invention. The air treating device 10 has a support or attaching frame 11 on which is mounted a bellows box 12 in which is secured a bellows compressor 13. The compressor 13 is formed of two spaced apart memory shaped diaphragms 14 and 14' which are secured in spaced relationship within the bellows box chamber 15 by a compressor support frame 16, as will be further described with reference to FIGS. 2 and 3.

Figure 2:
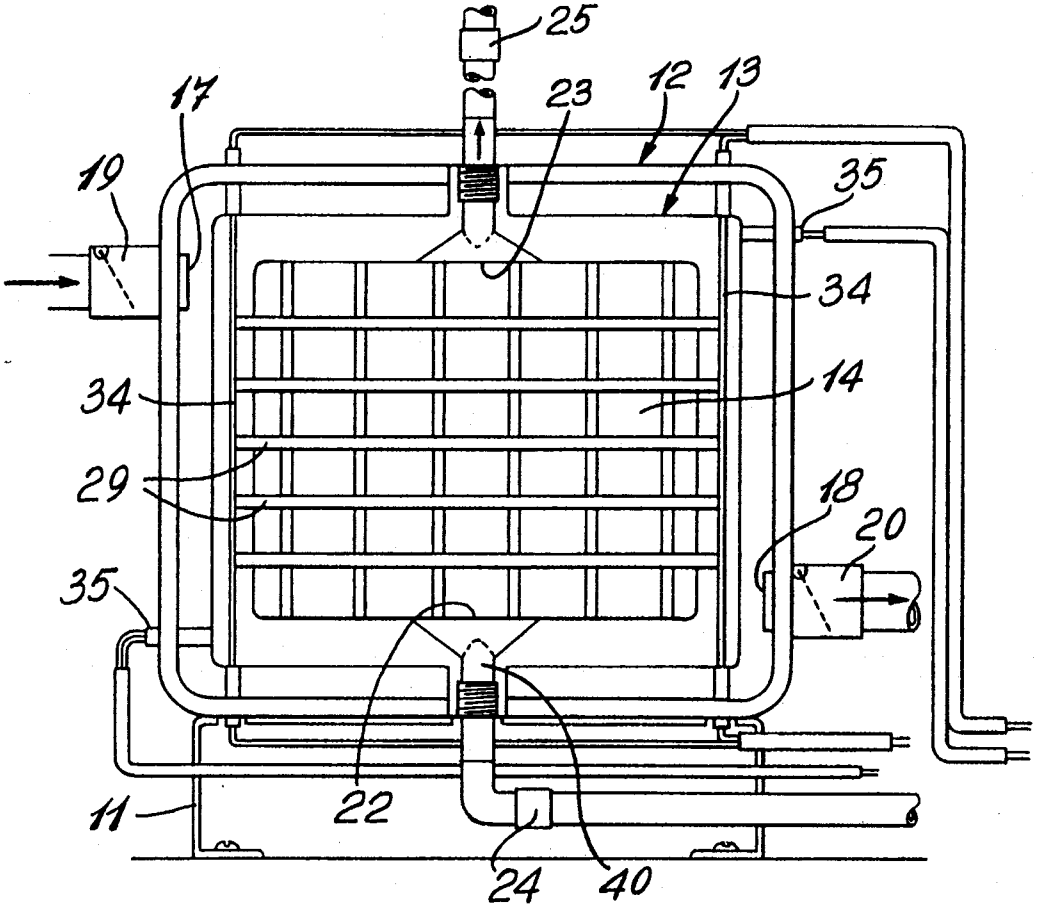
FIG. 2 is a sectional view showing the construction of the bellows box and the diaphragm positioned therein.

The bellows box chamber 15 is provided with an inlet opening 17 and an outlet opening 18 to cause air to move in and out of the bellows box chamber. Each inlet and outlet opening is provided with unidirectional valves 19 and 20 to cause unidirectional airflow through the bellows box chamber. These valves are illustrated in FIG. 2. The space between the bellows compressor diaphragms 14 and 14' defines an inner chamber 21, which chamber is provided with a gas entry port 22 and a gas outlet port 23. A unidirectional valve 24 is associated with the inlet port 22 and a unidirectional valve 25 is connected to the gas outlet port 23, as is also shown in FIG. 2. These valves permit the entry and exit of a refrigerant fluid within the inner chamber 21.

A condenser 26, having a condenser coil 27 therein, is shown in FIG. 1 as being mounted about the bellows box 12 and connected to the gas entry port 22 and the gas outlet port 23 so that the gases expelled from the inner chamber 21 may be condensed and readmitted as liquid through the gas entry port 22 through a venturi 41 (see FIG. 5), as will be shown and described later, to vaporize into the inner chamber 21. An air displacement means, in the form of a fan 28, cools the condenser coils 27, and it is pointed out that other cooling means may be provided and mounted differently from that illustrated in FIG. 1.

Figure 4:
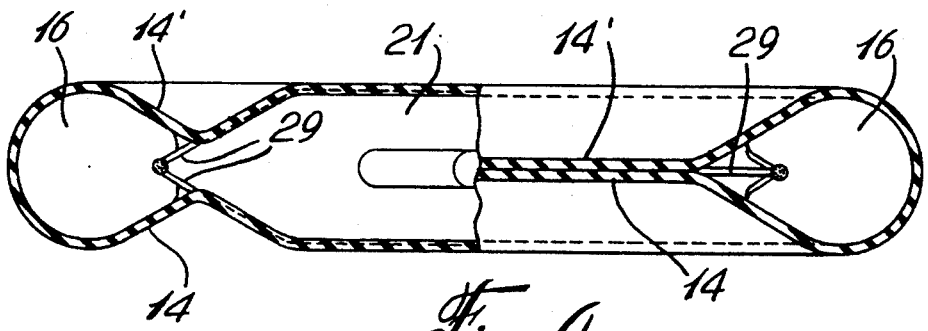
FIG. 4 is a cross-section view along cross-section lines A—A of FIG. 2 illustrating the diaphragm in its contracted and expanded conditions.
Figure 5:
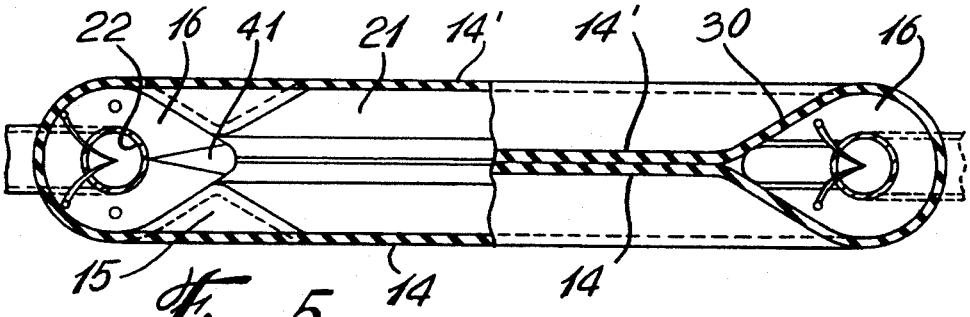
FIG. 5 is a cross-section view along cross-section lines B—B of FIG. 2 showing the diaphragm in its expanded and contracted conditions.
Figure 6:
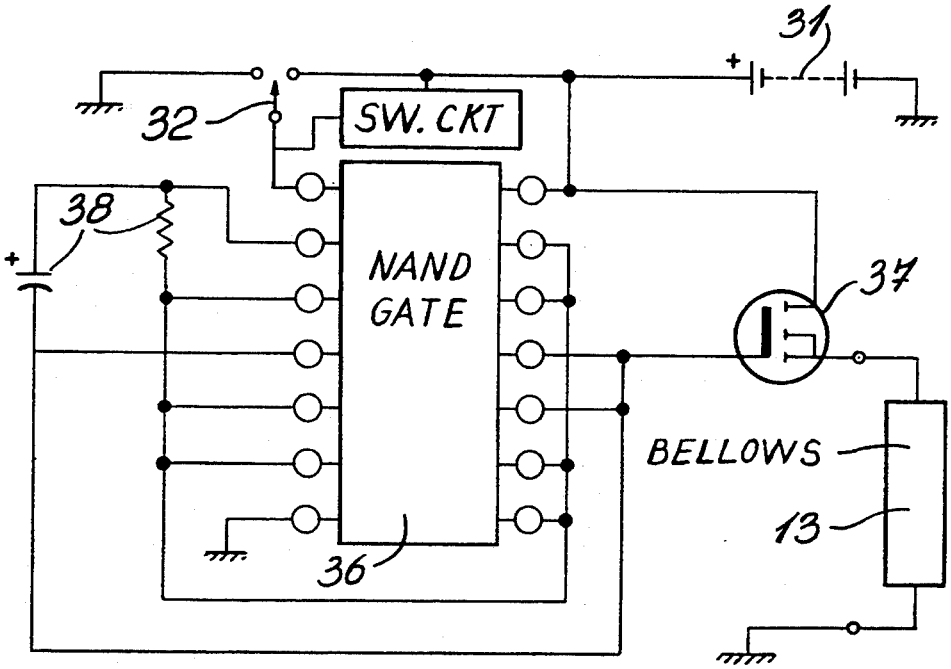
FIG. 6 is a schematic view illustrating the manner in which the supply source is connected to and controlled to feed the memory-shaped metal alloy elements and cause them to oscillate the diaphragms of the bellows compressor.

Referring now additionally to FIGS. 2 to 5, there is shown the construction and operation of the bellows compressor. The diaphragms are generally rectangular membranes made of semi-rigid reinforced plastic netting which is cemented between an inner and outer rubber skin. There are also two separate layers, (see FIG. 2) of memory-shaped metal alloy elements 29 and 30 which are electrically isolated from one another. One of these layers, namely the inner layer of wires 29 as shown in FIG. 4, causes the diaphragms to contract when heated while the other layer of wires 30, as shown in FIG. 5, causes the diaphragms to expand when heated. These memory-shaped metal alloy elements are heated by suitable means and, as shown in FIG. 6, this heating means is constituted by a 9-volt DC battery 31. This battery is connected to the bellows either through a mechanical switch 32 which may be hand-actuated, or an electronic switching circuit 33 which may be set to cause the bellows to oscillate at a specific rate or frequency. The switching circuit connects the supply 31 to either layers of memory-shaped metal alloy elements through a pair of distribution wires 34, as shown in FIG. 2 connected to the inner layer of wires 29, or distribution wires 35 connected to the second or outer layer of memory-shaped metal alloy elements 30.

A NAND gate 36 acts as a square wave generator and provides a square wave power supply to heat the wires evenly throughout their lengths, a moffset 37 is provided as an interface between the memory-shaped metal alloy elements in the bellows compressor as the NAND gate cannot handle the current required by the memory-shaped metal alloy elements. Coupling circuit components 38 are provided for the NAND gate 36.

As shown in FIG. 2, the memory-shaped metal alloy elements are straight wires disposed in spaced apart parallel relationship and connected at opposed ends to the distribution wires 34 and 35. As shown in FIG. 4, the inner layer of conductive wires 29 is disposed in a plane substantially coextending with the diaphragms 14 and 14' when in their collapsed position, whereas the other layer of memory-shaped metal alloy elements 30 is disposed in a plane substantially coextending with the diaphragms when expanded, and that being when the memory-shaped metal alloy elements are heated.

As shown in FIG. 2, the diaphragms are supported spaced from the bellows box 12 by the neck extensions 39 and 40 surrounding the outlet and inlet ports of the bellows compressor inner chamber.

With specific reference to FIGS. 1, 4 and 5, it can be seen that when heat is applied to the outer layers 30 of the memory-shaped metal alloy elements, the diaphragms 14 and 14' will be caused to expand thereby drawing a refrigerant fluid through a venturi port 41 associated with the gas entry port 22 and thereby causing the liquid refrigerant fluid which has condensed in the condenser 26 to vaporize within the inner chamber 21. The reduced pressure resulting in the inner chamber by the expansion of the diaphragms, and hence the chamber, causes this vaporization of the refrigerant fluid, and the vapor gas cools the diaphragms 14 and 14'. The expanded diaphragms also cool the air in the bellows box chamber 15, and at the same time forces the cooled air to exit through the outlet port 18 of the bellows box chamber 15 thereby providing cooled air at the outlet to feed an environment to be cooled.

As shown in FIG. 4, in the expanded cycle on the left side of the Figure, the outer layer wires 30 cool down quickly as the current is switched therefrom and applied to the inner layer wires 29. These wires 30 then expand and reassume their normal straight state to extend coextensively with the collapsed diaphragms, as shown on the right side of FIG. 4. This causes the diaphragms to quickly move in towards one another and causing the gas inside the inner chamber 21 to be expelled through the outlet port 23 and to enter into the condenser coils 27.

The bellows box is provided with at least opposed shaped smooth walls to receive the diaphragms thereagainst when expanded. The diaphragms are also supported at a fixed position relative to these opposed walls. The rubber utilized in the construction of the diaphragm is of a type that exhibit elasticity at low temperatures and which is capable of withstanding rapid flexing. The rubber further does not react and is impenetrable by the refrigerant fluid. The memory-shaped metal alloy elements are secured embedded into the diaphragms. The memory-shaped metal alloy elements herein shown are constructed of nickel titanium and are capable of reacting at 57° C. and capable of cooling in about 1/120th of a second by the refrigerant fluid when at a temperature of about 0° C. These layers of wires also have a reflex strength of about 61 psig to compress the fluid as the wires straighten and shorten when they are heated by an electric current flowing therethrough.

It is also pointed out that the bellows box is a sealed housing constructed of suitable plastics material. The walls are shaped such as to provide an improved laminar airflow and rapid air intake and exhaust through the inlet and outlet ports.

The condenser 26 is also provided with an absorbent material in its cooling coil to prevent impediments to refrigerant fluid flow to the bellows compressor by uncondensed gas resulting from displacement or mounting of the device. For example, if the device is positioned up-side down, this could cause an impediment to refrigerant fluid flow. This absorbent may be in the form of a saturated sponge material, such as activated carbon 9 (see FIG. 1), which is disposed in a header (not shown) of the condensing coil 27 at the gas entry port of the bellows compressor. A wick may also extend into the condenser coil. Since there will be many condenser tubes, capillary action in the wicks should suffice. To overcome any problem in this regard, the absorbent activated carbon material will help absorb gas bubbles under pressure. On cooling all gas should become liquid. A reduction in pressure on the suction side of the sponge during the intake stroke of the diaphragms does, however, take place which vaporizes the gas at 0° C. entering the bellows through the venturi. The refrigerant chosen, out of many suitable refrigerants which can be used, for this application is Gentron 123 (Registered Trademark) which is a very low ozone depleting compound that replaces CFC-11. The switching circuit 33 may also be computer controlled, as is obvious in the art. The memory-shaped metal alloy elements may be insulated by simply coating them with a silicon lubricant or other suitable products may be used as an insulator.

For infinite longevity with no degradation of the wires, they have been formulated not to shorten more than 6% into the straight line position. By introducing a pair of diaphragms it is possible to maintain this required volume. Furthermore, although the memory-shaped metal alloy elements are herein shown as heated by the use of a DC battery to provide a current flow through the wires, it is also conceivable that the wires may be heated by an electrical heating element at their point of maximum expansion. They could also be heated through electromagnetic induction. Dielectric heating of a surface coating on the wires is also possible.

As previously stated, one of the applications of the air treating device 10 of the present invention is to cool the suit of air fighter pilots and the device was designed to maintain an airflow of 10 cu. ft./min. and reduce the air temperature 50° F. This can be achieved even if the ambient temperature reaches 100° F. The unit is also powered by a 9-volt battery capable of 2-hours continuous operation and this battery could be supplemented by standby rechargeable batteries.

It is within the ambit of the present invention to cover any other obvious modifications of the example of the preferred embodiment illustrated herewith, provided such modifications fall within the scope of the appended claims.

I claim:

1. An air treating device comprising a bellows box in which is secured a bellows compressor formed of two spaced apart diaphragms having memory-shaped metal alloy elements, means to cause said elements to heat, switch means to cause said diaphragms to expand and contract at a predetermined rate, said diaphragms being secured in spaced sealing relationship and defining an internal chamber therebetween, a gas entry and exit port in said internal chamber, unidirectional valve means associated with said ports to permit entry and exit of a refrigerant fluid, a condenser connected to said ports for the flow of said refrigerant fluid therethrough in a closed circuit, said condenser having a condensing coil, air displacement means associated with said condenser, said bellows box having a unidirectional airflow path therethrough, said diaphragms when expanding drawing said refrigerant fluid through said entry port by suction and reduced pressure and thereby causing said refrigerant fluid to vaporize and cool said diaphragms as they expand, said expanded diaphragms cooling air in said unidirectional airflow path by heat exchange and simultaneously displacing cooled air in said path, said diaphragms when contracting causing said vaporized fluid to be expelled through said exit port into said condenser.

2. An air treating device as claimed in claim 1 wherein each said diaphragm is provided with two separate layers of memory-shaped metal alloy elements electrically isolated from one another, one said layer causing said diaphragm to contract when said memory-shaped metal alloy elements are heated and said other layer causing said memory-shaped metal alloy elements to expand when its memory-shaped metal alloy elements are heated.

3. An air treating device as claimed in claim 2 wherein one of said layers of memory-shaped metal alloy elements are connected at opposed ends in a plane substantially coextending with said diaphragms when in a contracted position, and said other of said layers of memory-shaped metal alloy elements being connected at opposed ends in a plane substantially coextending with said diaphragms when expanded.

4. An air treating device as claimed in claim 3 wherein said means to cause said memory-shaped metal alloy elements to heat is a DC battery connected to said memory-shaped metal alloy elements through said switch means to cause a current to flow through said memory-shaped metal alloy elements and cause them to contract to thereby cause said diaphragms to also contract.

5. An air treating device as claimed in claim 4 wherein said current is generated from a square wave pulsed supply voltage whereby said memory-shaped metal alloy elements will heat evenly throughout their length.

6. An air treating device as claimed in claim 1 wherein said diaphragms are supported spaced from at least two opposed walls of said bellows box adjacent expanding membranes of said diaphragms.

7. An air treating device as claimed in claim 4 wherein said diaphragms are generally rectangular membranes made of semi-rigid reinforced plastic netting cemented between an inner and outer rubber skin, said memory-shaped metal alloy elements being secured in said netting.

8. An air treating device as claimed in claim 7 wherein said rubber is of the type exhibiting elasticity at low temperature and capable of withstanding rapid flexing and further being non-reacting and impenetrable to said refrigerant fluid.

9. An air treating device as claimed in claim 2 wherein said memory-shaped metal alloy elements are straight wires embedded in said diaphragms.

10. An air treating device as claimed in claim 9 wherein said layers of memory-shaped metal alloy elements comprise a plurality of said wires disposed in spaced parallel relationship in each said diaphragm, said wires being coated with a silicone lubricant and connected at opposed ends thereof to power distribution wires.

11. An air treating device as claimed in claim 10 wherein said wires are constructed of nickel titanium capable of reacting at 57° C. and capable of cooling in about 1/120th of a second by said refrigerant fluid at 0° C., said wires in combination having a reflex strength of 61 psig to compress said fluid as said wires straighten and shorten when said wires are heated.

12. An air treating device as claimed in claim 1 wherein said bellows box is a sealed housing having an inlet opening and an outlet opening, said airflow path being defined between said openings and about said bellows compressor, and a unidirectional valve connected to said inlet and outlet openings, said housing having inner walls which are shaped walls which conform to the inflated shape of said bellows compressor to improve laminar airflow and rapid air intake and exhaust through said inlet and outlet openings, respectively.

13. An air treating device as claimed in claim 1 wherein an absorbent material is disposed within said condensing coil to prevent impediment to refrigerant fluid flow to said bellows compressor by uncondensed gas resulting from displacement of said device and said condenser.

14. An air treating device as claimed in claim 13 wherein said absorbent is a saturated sponge material disposed in a header of said condensing coil at said gas entry port of said bellows compressor, and a wick extending into said condenser coil.

15. An air treating device as claimed in claim 14 wherein said saturated sponge material is activated carbon.

16. An air treating device as claimed in claim 4 wherein said DC battery is connected to a square wave generator circuit comprising a NAND gate and pulsating at a desired frequency.

17. An air treating device as claimed in claim 16 wherein said switch means is a computer controlled switching circuit.

18. An air treating device as claimed in claim 1 wherein said device is a gas compressor having storage means for storing said gas in a gaseous or liquid form.

* * * * *